US005301964A

United States Patent [19]

Papac

[11] Patent Number: 5,301,964

[45] Date of Patent: Apr. 12, 1994

[54] WHEELCHAIR

[76] Inventor: James B. Papac, 1366 Village Ct., Simi Valley, Calif. 93065

[21] Appl. No.: 38,111

[22] Filed: Mar. 29, 1993

[51] Int. Cl.[5] ..... A61G 5/00

[52] U.S. Cl. ..... 280/250.1; 297/DIG. 4

[58] Field of Search ..... 280/250.1, 304.1; 297/313, 337, 338, 383, DIG. 4

[56] References Cited

U.S. PATENT DOCUMENTS

| | | | |
|---|---|---|---|
| 3,952,822 | 4/1976 | Udden et al. | 180/907 X |
| 4,592,562 | 6/1986 | Strautnieks et al. | 280/250.1 |
| 5,131,672 | 7/1992 | Robertson et al. | 280/250.1 |
| 5,176,393 | 1/1993 | Robertson et al. | 280/250.1 |

FOREIGN PATENT DOCUMENTS

| | | | |
|---|---|---|---|
| 2141980 | 1/1985 | United Kingdom | 280/250.1 |
| 8201313 | 4/1982 | World Int. Prop. O. | 297/DIG. 4 |

*Primary Examiner*—Margaret A. Focarino
*Assistant Examiner*—Victor E. Johnson
*Attorney, Agent, or Firm*—Robert Louis Finkel

[57] ABSTRACT

This wheelchair incorporates a unitary supporting frame for the drive wheels and swivalable casters, and an adjustable seating assembly. The supporting frame is adjustable to change the wheelbase, track, and frame pitch and thereby shift the user's center of gravity and orientation with respect to the wheels. In a preferred embodiment provision is made for adjusting and maintaining the alignment of the wheels and casters. The seating assembly allows the seat and seat back to be positioned independently to suit the user's size, posture, balance, and other physical characteristics. A powered seat mount allows the user to raise and lower the seating assembly.

9 Claims, 2 Drawing Sheets

FIG. 5
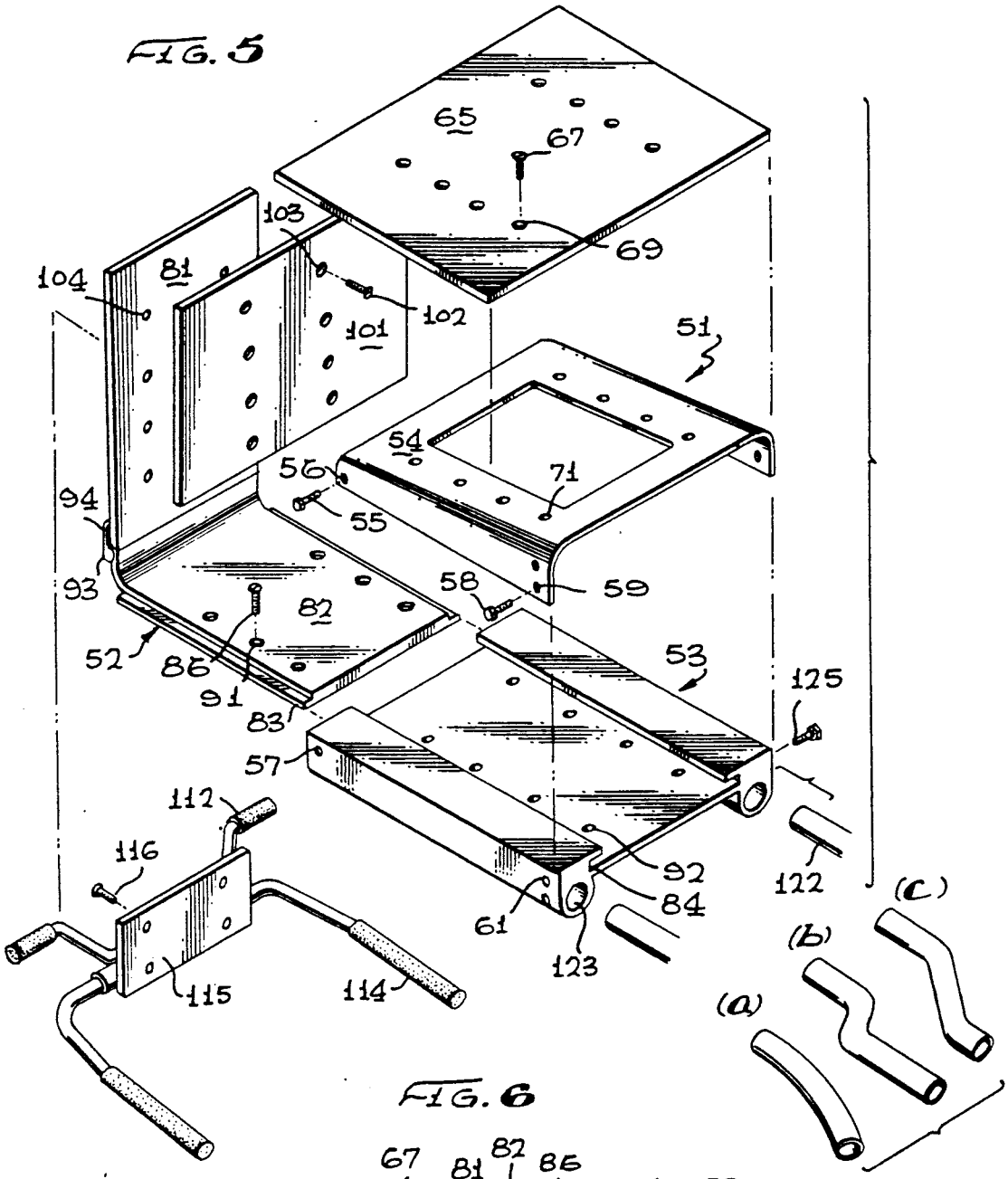
FIG. 6
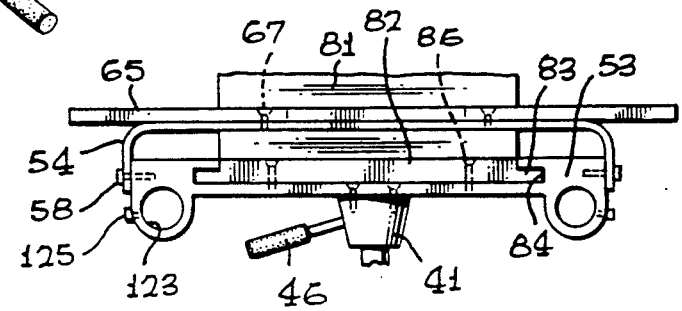
FIG. 3

WHEELCHAIR

BACKGROUND OF THE INVENTION

1. Field of the Invention

This invention relates to manually propelled wheelchairs and their construction, and more particularly to a wheelchair construction that affords the disabled user not only mobility, but proper seating and positioning, as well.

2. Prior Art

Over the past 60 years the development of the metal manually propelled wheelchair has provided many who would otherwise have been shut out of society because of their disability a way to return to the mainstream. During the most recent decade, in response to the growth in the number of disabled and heightened public awareness of their problems, great strides have been made in the direction of decreasing the weight and improving the efficiency, durability, and maneuverability of both folding and non-folding wheelchairs. Technological progress has not been without its drawbacks, however.

The manufacture of a conventional wheelchair involves the fabrication, sub-assembly, and assembly of as many as two hundred fifty or three hundred individual parts. The production of each unit is complex and time consuming because certain parts and components have to be fabricated specifically for each wheelchair. Wheelchairs today are manufactured in frame widths from 10" to 20", frame depths from 14" to 18", and varying back heights, seat heights, configurations, materials, finishes, and colors. For the manufacturers, the diversity and inherent inefficiencies of the new designs have driven up production and inventory costs and created stocking nightmares. Similarly, for the distributors and retailers, maintaining an adequate inventory to fill all the possible combinations is extremely difficult and expensive.

Another major deficiency in current wheelchair design is that most of the dimensions must be chosen at the time the chair is ordered. Modifying the typical wheelchair after manufacture, for example, to correct a mistake in the order or to meet the changing needs of the user, is difficult and, in some instances, impossible. A few of the prior art designs provide for certain changes. These generally require the costly addition or replacement of wheelchair components, however, or the equally costly adjustment or modification of existing components by a specially trained service technician.

Additionally, for all of its advances, the present wheelchair technology offers little in the way of improved seating. With few exceptions, contemporary wheelchairs still use the sling seats and seat backs and fixed mounting structures that were designed for the wheelchairs of the 1940's. Sling seating has a number of shortcomings: It is uncomfortable and over time is ruinous to good posture. Being flexible, it cannot provide stable support to the user when the wheelchair is in motion, and particularly when he or she is propelling the chair manually. And it is not readily adjustable to position the user either for the most efficient use of the drive wheels, or for the most desirable balance.

Although the limitations and deficiencies inherent in this type of seating are well known, scant attention has been paid by the wheelchair designers to the sitting comfort, posture, stability, and positioning of the disabled user. Most of the advances in these areas have come in the form of various devices, such as solid seats and backrests, cushioned interfaces, fabric covers, and the like, that are made to mount on, or attach to, existing wheelchairs. To adjust user's position or the chair's balance, the common method is to provide means for repositioning the wheels or the casters on the chassis.

As a rule, because these products are "add-ons," rather than integrated components of the initial design, they tend to be cumbersome and awkward to use. Generally, they require substantial hardware and considerable effort to install. Furthermore, since there is little, if any, standardization among the various makes and models of wheelchairs on the market, these retrofit devices are generally designed for use with a specific wheelchair or type of wheelchair construction. As in the case of the wheelchair designs, the diversity and inefficiency of these seating devices makes their manufacture, stocking, inventorying, and modification difficult and expensive and likely to remain so.

Viewed against this background, one object of the subject invention is to provide a wheelchair construction that affords the advantages and overcomes the deficiencies inherent in prior art wheelchairs.

Another object is to provide a wheelchair contruction that is sturdy, lightweight, and durable.

Yet another object is to provide a wheelchair that incorporates proper seating for the disabled user as an integral part of its construction.

An additional object is to provide a wheelchair construction in which the user's center of gravity is shifted longitudinally of the frame by moving the seat on the frame rather than by moving the wheels on the frame.

A more particular object is to provide a wheelchair construction of this type that can be fabricated from a minimum number of parts.

Still another object is to provide a wheelchair construction that incorporates in a single integrated structure a unitary lower main frame supporting the wheels and casters, and an adjustable upper seating assembly.

A further object is to provide a wheelchair construction of this type that permits the standardization and use of interchangeable individual parts and modular components.

A still further object is to provide a wheelchair construction of this type having means for adjusting the wheelbase, frame-pitch, wheel and caster tracking, drive wheel and caster camber, seat length and height, seat back height, seat and seat back longitudinal positioning, armrest width and height, footrest length and depth, and push-handle configuration and positioning.

Yet a further object is to provide a wheelchair construction satisfying all of the foregoing objects that is comparatively inexpensive to manufacture and requires a minimum of maintenance and repair.

Other objects will become apparent from the following summary of the invention and detailed description of its preferred embodiments.

SUMMARY OF THE INVENTION

A wheelchair in accordance with the subject invention comprises a lower chassis and an integrated upper seating assembly. The drive wheels and swiveling casters are mounted to the lower chassis, a wishbone-shaped main frame, the wheels to a transverse axle passing through the body of the frame and the casters to a pair of limbs extending divergently from the body. In a preferred embodiment, the limbs are offset and are journalled for rotation, and adapted for telescoping movement in the frame body, thereby allowing not only the pitch of the frame and the distance between the casters, but also the wheelbase of the wheelchair, to be adjusted.

The seating assembly combines a seat control assembly and a seat back control assembly. The seat control assembly allows the pitch of the seat to be adjusted to enhance the user's posture and comfort. The back control assembly permits the seat back to be moved forwardly and rearwardly thereby shifting the user's center of gravity on the chassis and his or her position with respect to the drive wheels. Additionally, the seat control assembly and seat back control assembly are adapted to support a variety of seat plates and back plates of independent sizes and shapes and which can be given a standardized surface treatment or upholstered to order, allowing the chair to be configured specifically to conform to the user's size, weight, personal needs, and tastes.

In one preferred embodiment of the invention, modular, adjustable, push-handles and armrests are mounted to the seat back control assembly, and a pair of adjustable footrests are mounted to the seat control assembly.

The seating assembly is mounted to the main frame by means of a seat-mount, preferably incorporating a shock-absorbing manually controlled pressure-operated ram that allows the chair's user to adjust the height of the seating assembly at will.

For a fuller understanding of the invention, reference is made to the following detailed description of the embodiments illustrated in the accompanying drawings, in which:

BRIEF DESCRIPTION OF THE DRAWINGS

FIG. 3 is a reduced perspective view of several typical alternative embodiments of the limb portion of the main frame of the invention;

FIG. 5 is a fragmentary, partially-exploded top-frontal perspective view of the seating assembly of the wheelchair shown in FIG. 1; and FIG. 6 is an enlarged, fragmentary sectional view of the seating assembly of the wheelchair shown in FIG. 1, taken along the line 6—6.

Wherever practicable, the same numeral is used to identify identical or substantially similar features appearing in the several figures.

DETAILED DESCRIPTION OF THE PREFERRED EMBODIMENTS

Figure 1:
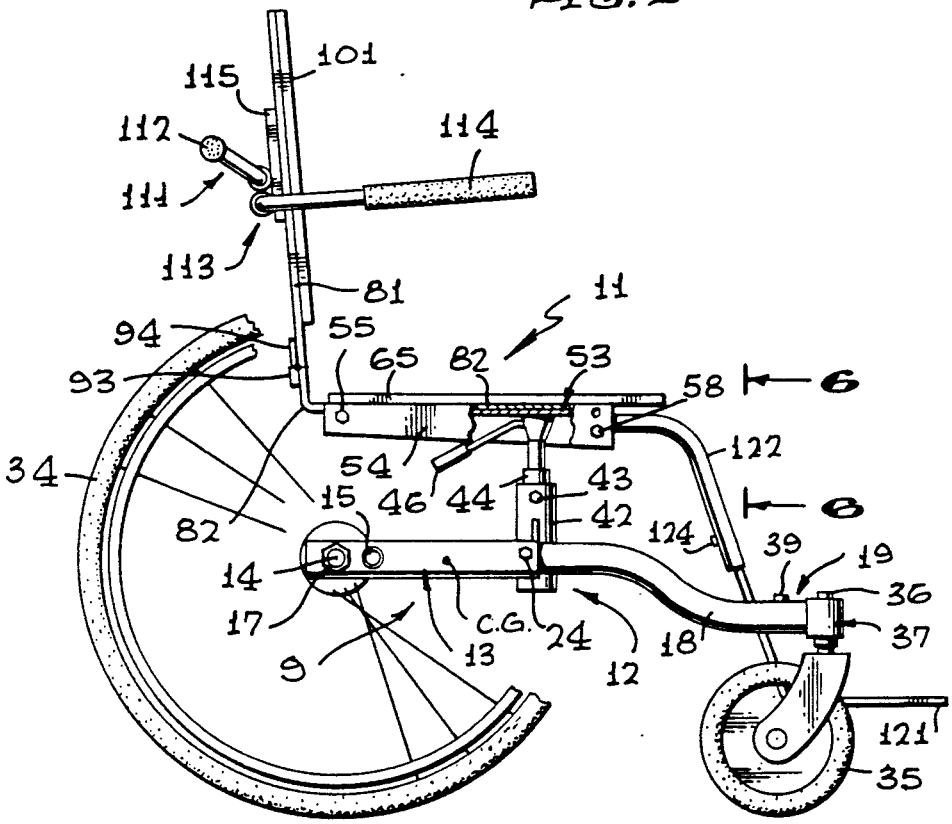
FIG. 1 is a side elevational view of a wheelchair in accordance with the invention with portions cut away to expose its construction.

Referring to FIG. 1, a wheelchair embodying the subject invention includes a chassis 9 and a seating assembly 11. The chassis 9 incorporates a unitary, generally wishbone-shaped main frame 12 having a body 13 of suitable lightweight, strong, durable construction. By way of example, body 13 may be fabricated of cast or sheet metal, or molded of any one or combination of well known plastic or composite materials.

A transverse axle 14 is formed integrally with, or mounted rigidly to, body 13. Conveniently, axle 14 may be a rigid, one-piece shaft securely mounted to body 13 through a sleeve, or as in the embodiment illustrated in FIG. 2, one of two or more spaced sleeves 15 having threaded ends 16 adapted to engage a pair of opposed lock-nuts 17 provided on the shaft. Positioning transverse axle 14 in one or another of sleeves 15 effects not only the wheelbase (and thus the stability of the wheelchair), but the location of the center of gravity ("CG") of the chair and seated user with respect to the longitudinal axis of main frame 12 as well.

Figure 4:
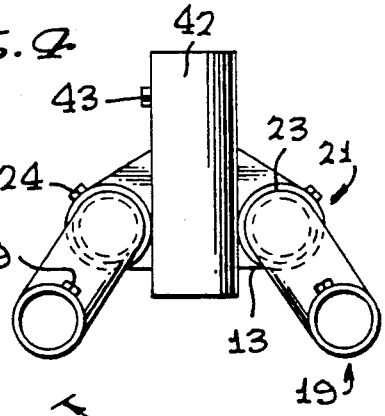
FIG. 4 is a fragmentary sectional view of the main frame shown in FIG. 2, taken along the line 4—4, with portions of the frame shown in phantom.
Figure 2:
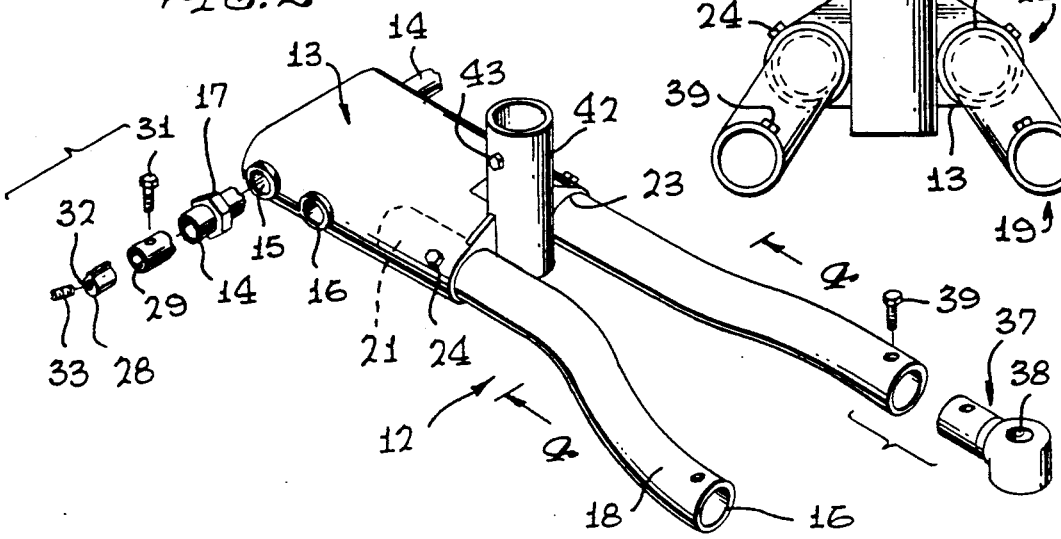
FIG. 2 is an enlarged, fragmentary, partially-exploded top-frontal perspective view of the main frame of the wheelchair shown in FIG. 1.

Referring to FIG. 2, a pair of divergent, rigid, preferably tubular limbs 18 formed of suitable metal, plastic, or composite material are attached at one of their ends to one end of body 13. As illustrated by the preferred embodiment of FIG. 2 and the three typical alternative embodiments "a," "b," and "c" depicted in FIG. 3, the limbs 18 may take a variety of shapes. It will be understood that the term "divergent" is intended to encompass not only those shapes, but any others having the free ends 19 of limbs 18 radially offset, i.e., laterally displaced, from their ends 21 which are attached to body 13. The significance of this construction will become apparent from a consideration of FIG. 4.

Limbs 18 may be attached permanently and immoveably to body 13. Preferably, however, they are journalled to body 13 for rotation about their ends 21. In the embodiments illustrated, a pair of sleeves 23 formed in the end of body 13 to receive the ends 21 of limbs 18 allow limbs 18 not only to be rotated, but to be telescoped axially in body 13 as well. Releasable restraining means, such as set screws 24, are provided for immobilizing the limbs 18 once they have been adjusted as desired. Whether limbs 18 are fixed to body 13 at the time of manufacture or moveable, their configuration provides means for positioning their ends 19 vertically and horizontally with respect to body 13, and for determining the overall length and width of the chassis 9.

A pair of wheel mounting plugs 28 are keyed to prevent their rotation in bores 29 formed in the ends of transverse axle 14. Set screws 31 or other convenient restraining means retain plugs 28 in bores 29. Plugs 28 are tapped and threaded internally to provide bores 32 for receiving the threaded ends of the axles 33 of drive wheels 34. Preferably bores 32 are formed at a predetermined angle to the longitudinal axes of plugs 28. The axial orientation of plugs 28 in bores 29 determines the camber of drive wheels 34. Once the wheel axles 34 have been threaded into bores 32 and mounted to transverse axle 14 by securing plugs 28 in bores 29 by means of set screws 31, the need for future adjustments is effectively eliminated. Should the user desire to change the wheels, camber, doing so requires only the replacement of plugs 28 with plugs having bores 22 with the desired axial angle.

A pair of swivable casters 35 having mounting shafts 36 are mounted to limbs 18 by means of caster mounting plugs 37. The telescoping of limbs 18 thus serves to lengthen or shorten the wheelbase and to move the center of gravity of the chair and user forwardly or rearwardly on main frame 12. The rotation of limbs 18 allows the user to adjust both the pitch or tilt of the chassis with respect to the surface 22 under the wheelchair and the spacing between the casters 35. These features, in combination with the previously mentioned effects of mounting transverse axle 14 to one or another of sleeves 15, allow the user to rig the wheelchair precisely to his or her specifications for comfort, balance, and efficient operation.

Plugs 37 are rotatably mounted to the free ends 19 of limbs 18. Plugs 37 contain radial bores 38 for receiving caster shafts 36. Rotating plugs 37 in limbs 18 varies the camber of casters 35, thus allowing the user to adjust the balance and turning characteristics of the chair to his or her liking and affording compensating for the rotation of limbs 18 to adjust the wheelbase or the tilt of the chassis. Restraining means, such as set screws 45, are provided for retaining plugs 43 in their selected positions.

Seating assembly 11 is mounted to chassis 9 by means of a seat mount 41 secured to the underside of seat base 53. Seat mount 41 is adapted for insertion into a receptacle 42 rigidly mounted to the main frame 12. A set screw 43 or other conventional engaging means releasably retains seat mount 41 in receptacle 42.

Seat mount 41 includes adjustment means, such as pressure operated ram 44 having a conventional rechargeable or replaceable pressure source (not shown). A conveniently positioned control lever 46 allows the user to adjust the height of seating assembly 11 at will.

Referring now to FIGS. 5 and 6, seating assembly 11 includes a seat control assembly 11 and a seat back control assembly 52. The seat control assembly 51 comprises a rigid seat base 53. A seat mounting bracket 54 is hingedly mounted at one of its ends to seat base 53 by means, such as pins 55 passing through holes 56 in bracket 54 and threaded into bores 57 in seat base 53. Attachment means, such as pins 58 passing through one of several positioning holes 59 in bracket 54 and threaded into bores 61 in seat base 53, are provided for rigidly securing seat mounting bracket 54 to seat base 53 at a selected pitch angle.

A seat plate 65 is secured to mounting bracket 54 by suitable conventional means, such as flathead bolts 67 passing through countersunk holes 69 in seat plate 65 and threaded into bores 71 in bracket 54. Although illustrated for convenience as a substantially featureless, thin, rectangular element, it should be understood that plate 65 is intended to represent any suitable conventional form of unupholstered or upholstered seat structure appropriate to the particular disability, physical characteristics, and tastes of the wheelchair's user. By way of one typical example, plate 65 may be an exposed, unadorned, contoured shell of metal, plastic, or composite material. As another example, it may take the form of a comfortably padded, tastefully covered cushion mounted to a rigid backing of suitable material.

Seat back control assembly 52 comprises an upright rigid back support 81 mounted to a slide plate 82. As are most of the other components of the present embodiments, for example, seat base 53, mounting bracket 54, and seat plate 65, back support 81 and slide plate 82 are conveniently fabricated or formed of suitable lightweight, durable, metal, plastic, or composite materials.

Interlocking tongues 83 and grooves 84 on slide plate 82 and seat base 53 secure seat back control assembly 52 to seat control assembly 51 and afford slide plate 82 freedom of sliding reciprocal movement in recess 85 formed in seat base 53. Restraining means, such as flathead bolts 86 passing through countersunk holes 91 in slide plate 82 and threaded into bores 92 in seat base 53 allow the position of back support 81 on the longitudinal axis of main frame 12 to be readily adjusted.

Back support 81 and slide plate 82 can be fabricated as a single unit. To facilitate the transport and storage of the wheelchair, however, back support 81 is preferably mounted to slide plate 81 by means of a hinge 93. In this configuration conventional positioning means (not shown) are provided for retaining and adjusting the angle of back support 81 in its upright position. A conveniently placed lever 94 releases the locking mechanism and allows back support 81 to be rotated forwardly to lie flat on seat plate 65.

Like seat control assembly 51, seat back control assembly 52 makes provision for incorporating a customized seating component, here designated for convenience back plate 101, into the wheelchair. As with seat plate 65, back plate 101 can be fashioned of convenient materials in a variety of forms, unupholstered or upholstered, in accordance with the user's needs and tastes. Back plate 101 is mounted to back support 81 by suitable attachment means, such as flathead bolts 102 passing through countersunk holes 103 in back plate 101 and threaded into bores 104 in back support 81, which allow the back-supporting component of the chair to be adjusted vertically to suit the user's size, weight, and posture.

Push handle assembly 111 including handles 112, and armrest assembly 113 including armrests 114 are releasably attached by conventional attachment means (not visible) to mounting plate 115, allowing handles 112 to be adjusted to accomodate the stature of the wheelchair pusher and armrests 114 to be customized to the needs and tastes of the user. Releasable mounting means, such as flathead bolts 116 passing through countersunk holes 117 in mounting plate 115 and threaded into bores (not visible) in the back of back support 81 secure handles 112 and armrests 113 to back support 81. Further adjustments can be made either by reconfiguring the handles 112 or armrests 113, or both, on mounting plate 115, or by repositioning mounting plate 115 vertically on back support 81.

A pair of footrests 121 are mounted to seating assembly 11 by means of struts 122 inserted into sleeves 123 wherein convenient releasable locking means allow struts 122 to be telescoped and rotated for positioning footrests 121 to suit the user.

From the foregoing description, the advantages afforded by the novel features of the subject invention will be readily apparent. It should be understood, however, that although the invention has been described in terms of the specific constructions shown in the drawings, it is not to be construed as limited to those embodiments. They are to be regarded as illustrative rather than restrictive. This specification is intended to encompass any and all variations of the examples chosen for purposes of the disclosure, which do not depart from the spirit and scope of the following claims.

What is claimed is:

1. A wheelchair, comprising:

a unitary, wishbone-shaped main frame including a body; a pair of limbs extending divergently from said body and terminating in a pair of radially offset ends, said limbs being journalled for axial rotation on said body, whereby the position and spacing of the ends of said limbs are adjustable by rotating said limbs; a transverse axle mounted to said body; and attachment means for securing a seat mount to said main frame;

a pair of drive wheels mounted to said transverse axle, and a pair of swivable casters mounted to said limbs;

a seating assembly including a seat control assembly and a seat back control assembly, said seat control assembly comprising a seat mounting bracket that is adjustable in pitch, and said seat back control assembly comprising a back support that is moveable longitudinally of said main frame for supportingly positioning a seated user; and a seat mount on said seating assembly for mounting said seating assembly to said attachment means.

2. A wheelchair in accordance with claim 1 comprising:

a push handle assembly mounted to said seat back;

an arm assembly mounted to said seat back; and a pair of footrests mounted to said seating assembly.

3. A wheelchair in accordance with claim 1, wherein said limbs are mounted to said body for telescoping movement, whereby the wheelbase of the wheelchair can be adjusted by varying the length of said limbs.

4. A wheelchair in accordance with claim 1, wherein said wheels are mounted to wheel mounting plugs nonrotatably mounted to opposite ends of said transverse axle, said wheel mounting plugs containing nonaxially aligned mounting means for mounting said wheels with predetermined caster and camber.

5. A wheelchair in accordance with claim 3, wherein said casters are mounted to caster mounting plugs which are mounted to the ends of said limbs for rotation axially of said limbs, whereby the camber of said casters is adjustable by rotating said caster mounting plugs.

6. A wheelchair in accordance with claim 1, wherein said seat mount includes a pressure-operated ram for adjusting the height of said seating assembly.

7. A wheelchair in accordance with claim 1, wherein:

said seat control assembly includes a seat base, said seat mount being mounted to said seat base;

said back support is mounted upright to a slide plate, said slide plate being slidably mounted to said seat base;

restraining means acting between said slide plate and said seat base are provided for immobilizing said slide plate in selected positions; and said seat control assembly includes a seat mounting bracket hingedly mounted to said seat base, and attachment means for rigidly securing said seat mounting bracket to said seat base at a predetermined pitch angle.

8. A wheelchair comprising:

a unitary, wishbone-shaped main frame including a body, a transverse axle mounted to said body, attachment means for securing a seat mount to said main frame, and a pair of limbs extending divergently from said body and terminating in a pair of radially offset ends, said limbs being adapted for axial rotation and telescoping movement on said body, whereby the position and spacing of the ends of said limbs are adjustable by rotating said limbs on said body and the wheelbase of the wheelchair is adjustable by telescoping said limbs to vary their length;

releasable first restraining means for immobilizing said limbs with respect to said body;

a pair of drive wheels, each said drive wheel having an axle;

a pair of wheel mounting plugs nonrotatably mounted at opposite ends of said transverse axle, said wheel mounting plugs containing non-axially aligned bores for receiving the axles of said drive wheels;

a pair of swivable casters having mounting shafts;

a pair of caster mounting plugs rotatably mounted to the ends of said limbs, said caster mounting plugs containing radial bores for receiving said caster shafts, whereby the camber of said casters is adjustable by rotating said plugs;

a seating assembly including a seat control assembly and a seat back control assembly, said seat control assembly comprising a seat base, a seat mounting bracket hingedly mounted to said seat base, attachment means for rigidly securing said seat mounting bracket to said seat base at a selected pitch angle, and a seat plate adapted to be secured to said seat mounting bracket, said seat back control assembly comprising an upright back support for supportingly positioning a seated user on said wheelchair, said back support being mounted to a slide plate slidably mounted to said seat base for movement longitudinal of said main frame, restraining means acting between said slide plate and said seat base for immobilizing said slide plate in selected positions; and a seat mount secured to said seat base for mounting said seating assembly to said attachment means, said seat mount including a pressure operated ram for adjusting the height of said seating assembly.

9. A wheelchair in accordance with claim 8, comprising:

a push handle assembly mounted to said seat back;

an arm assembly mounted to said seat back; and a pair of footrests mounted to said seating assembly.

* * * * *